United States Patent [19]

Guichard

[11] Patent Number: 4,616,155

[45] Date of Patent: Oct. 7, 1986

[54] OVERVOLTAGE DISCHARGER FOR COAXIAL CABLES AND METHOD OF MAKING SAME

[75] Inventor: Francois Guichard, Paris, France

[73] Assignee: Compagnie Industrielle de Tubes et Lampes Electriques CITEL, Issy-les-Moulineaux, France

[21] Appl. No.: 629,099

[22] Filed: Jul. 9, 1984

[30] Foreign Application Priority Data

Jul. 18, 1983 [FR] France ..... 83 11830

[51] Int. Cl.[4] ..... H01J 17/04; H01J 17/16; H01J 17/18

[52] U.S. Cl. ..... 313/573; 313/574; 313/620; 313/631; 313/325

[58] Field of Search ..... 313/573, 574, 576, 620, 313/622, 623, 624, 625, 631, 643, 325, 575

[56] References Cited

U.S. PATENT DOCUMENTS 2,365,518 12/1944 Berkey et al. ..... 313/573

4,063,127 12/1977 Le Cain et al. ..... 313/625 X

*Primary Examiner*—David K. Moore

*Assistant Examiner*—K. Wieder

*Attorney, Agent, or Firm*—Brisebois & Kruger

[57] ABSTRACT

A bi-polar discharger for a coaxial conducting cable is formed by threading rod elements into the ends of a central passage through an internal electrode so as to be electrically conductive therewith. A casing around the internal electrode comprises a cylindrical outer electrode closed at each end by a bead of glass or ceramic which is fitted within an outer metal ring and the casing is sealed with a controlled atmosphere of an inert gas at low pressure by sealing of the outer rings to the cylindrical external electrode and sealing of the rod elements within the beads.

15 Claims, 4 Drawing Figures

OVERVOLTAGE DISCHARGER FOR COAXIAL CABLES AND METHOD OF MAKING SAME

FIELD OF THE INVENTION

The present invention concerns dischargers or overvoltage protectors and it relates more particularly to a discharger intended for the protection of coaxial conducting cables against overvoltages which may develop between the core and the screening braid of coaxial cables such as those used for the reception or transmission of high frequency or very high frequency signals, the said overvoltages being capable of damaging the dielectric layer of the coaxial cables.

PRIOR ART

In order to protect electrical circuits against overvoltages it is well known to use devices called "dischargers" or "overvoltage protectors" in these circuits. Such a device is generally constituted by at least two electrodes having facing surfaces within a casing sealed hermetically in a controlled atmosphere of an inert gas or gaseous mixture at a predetermined low pressure in the casing. At least two of the electrodes are each connected to one of the two current carrying poles and the spacing of the facing surfaces of the electrodes is such that when the difference in potential between the electrodes exceeds a certain threshold called the flashover voltage, an electric arc is established between the electrodes and the passing of the electric arc is accompanied by a sudden drop in voltage between the electrodes.

In particular, there are known dischargers comprising an electrode constituted by a tubular metallic casing element of a circular cross section delimiting the sealed enclosure for a controlled atmosphere; this tubular element is obturated at each one of its two ends by a glass or a ceramic bead fixed with a gas-tight seal within a metallic ring; the ring is made of an alloy which can be fused to the glass or ceramic; it is, itself, engaged or joined with a gas tight seal in the corresponding end of the central passage of the tubular electrode, for instance by a brazing on the outside of the ring on the corresponding end of the tubular electrode; at least one of the glass or ceramic beads is traversed in a gas tight manner by an extension, directed outwardly of the casing, of another electrode disposed coaxially within the tubular electrode.

To make a discharger of this type, the or an internal electrode, provided with its bead and its ring, is introduced into the tubular electrode and its ring is positioned at the corresponding end of the central passage of the tubular electrode, then the other ring and the corresponding bead, possibly traversed by another internal electrode, are positioned in the other end of the central passage of the tubular electrode, and finally the unit obtained is placed into a furnace. Before attaining the temperature whereat brazing of the beads occurs to produce the gas tight seal of the rings against the ends of the tubular electrode, a vacuum is obtained in the furnace in order to extract the gases from the casing; the furnace is then subjected to a controlled atmosphere so that the casing is filled with an inert gas or gaseous mixture under the predetermined partial vacuum. The temperature in the furnace is then caused to rise until a temperature is reached at which brazed seams are obtained to ensure the gas tight seal of the discharger casing.

In order to ensure the protection of coaxial cables against overvoltages, it has already been known to mount, in parallel between the core and screening braid of such a coaxial cable, a discharger of the bipolar type comprising a first electrode, joined for instance to the core and engaging coaxially in a second tubular electrode which is connected to the earthed screening braid.

But this design has the drawback that it destroys the coaxial configuration of the cable transmitting the signal so that the latter is very attenuated and, as a result, the discharger cannot be used for signals with a frequency exceeding 1 GHZ.

A bipolar discharger of the coaxial type is, moreover, known according to Published British Patent Application GB 2,083,945. However, according to this document, either the flashover of the electric arc is not localised longitudinally and may occur near the glass beads causing damage thereto, or where the flashover is localised that requires a component which is difficult to make and is fragile.

A bipolar discharger for coaxial cables is also known from U.S. Pat. No. 2,922,913. The electrodes use rapidly wearable pointed elements such as screws.

OBJECTS OF THE INVENTION

It is an object of the invention to overcome this drawback and to provide a discharger whose structure allows a coaxial cable to be used without entailing an undue attenuation of the signals whose frequency may greatly exceed the upper limiting frequency of the usable range of the prior art dischargers.

It is another object of the invention to provide a discharger which simultaneously allows continuous currents to pass and has a flashover voltage which can be chosen according to the strength of the signals received or transmitted by the coaxial cable.

It is a further object of the invention to provide a more robust discharger and one which is of a simple and economic construction.

SUMMARY OF THE INVENTION

The principle on which the invention is based consists in giving the discharger a structure which respects, and in some way extends, the coaxial configuration of the cable so that the compatibility between the discharger and the cable should be much better than in the prior art designs.

The bipolar discharger according to the invention is of the type comprising a casing sealed to be gas-tight and under a controlled atmosphere; the said casing encloses an inert gas or gaseous mixture in a predetermined partial vacuum; the discharger comprises two electrodes having opposed surfaces within the casing, one of the electrodes being an external electrode constituted by a metallic tubular element with a circular cross section partly delimiting the casing which is also delimited by two glass or ceramic beads obturating the central passage of the tubular electrode, or the extension of this passage, substantially at the level of each of the ends of the tubular electrodes; each of the above mentioned beads is mounted with a gas-tight seal in a metallic ring, itself mounted with a gas-tight seal in one end of the tubular electrode; the other electrode is an internal electrode constituted by a cylindrical metallic element with a circular cross section, disposed coaxially within the tubular electrode and being extended at one of its axial ends by a metallic rod element traversing the glass bead obturating the corresponding end of the casing with a gas-tight seal, the rod element having one end projecting outside the casing; at the other of its axial ends the internal electrode is extended by another metallic rod element which traverses the other glass bead obturating the corresponding end of the casing with a gas-tight seal, this other rod element also having an end projecting outside the casing and the two rod elements are intended to be connected each by its end projecting outside the casing to the core of a coaxial conductor, for instance by soldering, whilst the external electrode is intended to be connected, for instance, at its external lateral surface to the screening braid of the coaxial conductor; the internal electrode is separated from the external electrode by an annular flashover zone.

The diameter of the metallic element forming the internal electrode is larger than that of the rod; generally, the diameter of the metallic element is substantially twice the diameter of the rod.

Such a discharger has a coaxial configuration and its structure is compatible with the use in series with a coaxial cable for the transmission of an electric signal which may be continuous and whose frequency may amount to, both on transmission and on reception, up to 2 GHz without any notable ratio of standing waves and hence without undue line losses.

In a preferred embodiment, the internal electrode is also a tubular electrode having a central passage coaxial with the external lateral surface of the internal electrode and with the internal lateral surface of the external electrode, these two surfaces constituting the opposite surfaces of the two electrodes and each one of the two rod elements being held at its inner end in the casing within the central passage of the internal electrode.

This design has the advantage of facilitating the connection of the rod elements to the internal electrode.

The internal tubular electrode advantageously has two cylindrical axial end portions whose external diameter is smaller than that of the central portion of this internal electrode so that these two axial end portions may be used to ensure fixing to the latter of the one or the other of the two rod elements without any deformation whatever of the external lateral surface of the central portion of the said internal electrode, so that the distance between the two opposite surfaces of the two electrodes is not altered and so that the fixing of the rod elements to the internal electrode has no effect on the flashover voltage.

This is particularly the case when, in accordance with an advantageous characteristic of the invention, the inner end of at least one of the two rod elements is set in the corresponding end portion of the internal electrode.

In order to facilitate the insertion of the inner ends of the two rod elements in the central passage of the internal electrode, the central passage of this latter advantageously opens out in each axial end portion of the tubular internal electrode via a chamfered opening.

In order to ensure excellent electrical continuity between the two inner ends of the rod elements an electrically conductive element is preferably accommodated in the central passage of the internal electrode and the inner end of each one of the two rod elements is placed into contact with this electrically conductive element by its insertion in the central passage of the internal electrode.

But the electrical continuity may also be ensured by the welding of the inner end of each of the two rod elements to the internal electrode within the central passage of the latter.

The invention also relates to an advantageous method for making such a discharger and this method is characterised in that it consists in:

making separately and individually two fittings each constituted by a glass or ceramic bead mounted and fixed with a gas-tight seal in a metallic ring, the bead being traversed, with a gas-tight seal, by a metallic rod element which is coaxial with respect to the ring and has one end projecting on each side of the bead;

fixing one end of the rod element of one of the two fittings to an axial end of an internal electrode of the discharger constituted by a cylindrical metallic element;

inserting the internal electrode coaxially in an external electrode of the discharger, constituted by a tubular metallic element of a circular cross section and disposing the bead and the ring of the fitting joined to the internal electrode in a position obturating one axial end of the central passage of the external electrode;

positioning the other fitting so that its bead and its ring are disposed in a position obturating the other axial end of the central passage of the external electrode, and so that the end of its rod element projecting inwardly of the external electrode is in electrical continuity with the internal electrode and/or with the end of the rod element of the first fitting;

disposing brazing beads along the joints connecting the rings of the two fittings and the external electrode; and placing the unit into a furnace subjected to a vacuum, then placed under a controlled atmosphere in order to fill the casing which is delimited within the external electrode and the two fittings, with an inert gas at low pressure, then finally causing the temperature of the furnace to rise until the brazing of the rings on the external electrode is effected in order to close the casing in a gas-tight manner.

Preferably, the method moreover comprises:

piercing an axial passage in the said internal electrode so as to give the latter a tubular shape;

joining one end of the rod element of one of the two fittings to an axial end of the internal electrode after having inserted the said one end of the rod element in the axial passage of the said internal electrode; and ensuring the electrical continuity of the rod element of the other fitting with the said internal electrode after having also inserted the corresponding end of the said rod element in the axial passage of the said internal electrode.

In order to facilitate the insertion of the ends of the rod elements in the axial or central passage of the internal electrode, it is advantageous to chamfer beforehand the opening where the central passage of the internal electrode opens out at each axial end thereof.

Similarly, in order to facilitate the fixing of at least one of the rod elements on the internal electrode it is advantageous, before the first rod element is inserted in the said internal electrode, to form on the electrode two axial end portions having an outer diameter which is smaller than that of the central portion, and subsequently to fix to the internal electrode the end of the rod element of at least one of the said fittings by crimping the corresponding axial end portion of the internal electrode on the said end of the rod element.

It is also possible, before insertion of the second rod element in the central passage of the internal electrode, to accommodate an electrically conductive element in the said central passage, thereby ensuring electrical continuity between the two ends of the rod elements which are engaged opposite each other in the said central passage.

Such an electrical continuity can also be obtained after the unit has passed through the furnace, by electric arc welding by subjecting the two rod elements to an appropriate voltage so as to weld each of them within the internal electrode at the end of the rod element which is inserted into the central passage of the said internal electrode.

During the separate and individual making of the two fittings, the corresponding rod element may be mounted and fixed with a gas-tight seal within an inner ring which is itself mounted and fixed with a gas-tight seal to the corresponding glass or ceramic bead.

This may advantageously be obtained by means of rings of an alloy which fuses to the glass or ceramic so that the glass or ceramic bead should be fused to each ring. The corresponding rod element may be fixed to the internal ring by a brazing joint.

BRIEF DESCRIPTION OF THE DRAWINGS

In order that the present invention may be more readily understood, there will now be described one embodiment and variants, represented in the attached drawings, by way of illustrative examples. In these drawings.

DESCRIPTION OF THE PREFERRED EMBODIMENTS

Figure 1:
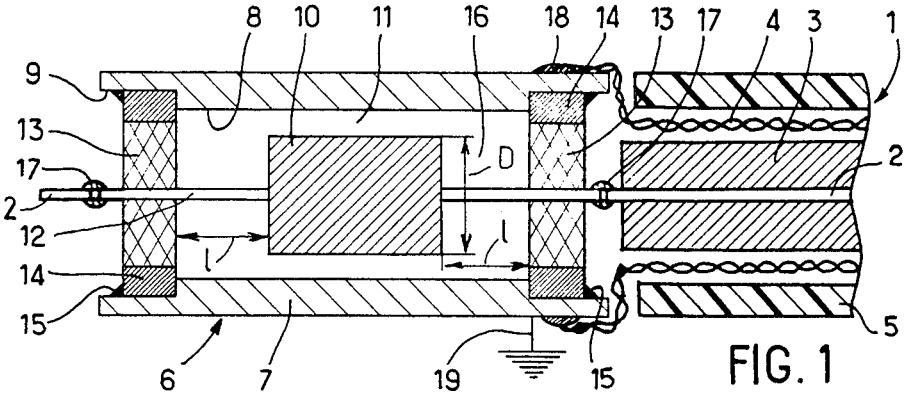
FIG. 1 is a schematic axial cross-sectional view of a discharger mounted on a coaxial line.

In FIG. 1, there has been represented a coaxial cable 1 for the transmission or reception of high frequency, or very high frequency, electric signals. The conductive core 2 has been bared by the removal of a part of the insulating cover 3. Similarly, the screening braid 4 of cable 1 has been freed by removing a portion of the mechanical protection sheet 5 of cable 1. The bipolar discharger 6 comprises a circular cross-section metallic tubular element 7 whose central passage, which is delimited by a bore 8, opens out at each one of its two ends in a recess 9 delimited by a counter bore with a diameter larger than that of bore 8.

A second metallic element 10, with a cylindrical outer shape, is disposed coaxially in bore 8 and constitutes an internal electrode having its external lateral surface facing the internal lateral surface of the tubular element 7 which constitutes an external electrode, the two electrodes 7 and 10 being separated from each other by an annular flashover zone 11.

The internal electrode 10 is extended axially at each of its two ends by a cylindrically shaped metallic rod 12 which passes in a gas-tight manner through a glass bead 13 positioned in a ring 14 of an alloy of iron, nickel and cobalt, called "Kovar", and which has the property of fusing to glass. Ring 14 is disposed in the corresponding recess 9 and is joined to the external electrode 7 in a gas-tight manner by a brazed joint 15.

Diameter D of the metallic element 10 is greater than that of rod 12. Generally, the diameter D is substantially twice the diameter of rod 12. The longitudinal distance l between each transverse end face of the part of element 10 (or 10', FIG. 2) of diameter D and the inner face of the neighbouring bead 13 is, preferably, at least equal to 1/6 of the distance between the facing internal faces of beads 13.

At its end projecting outside the sealed gas-tight casing 16 containing an inert gas under a partial vacuum, each rod element 12 is soldered at 17 to the core 2 of the coaxial cable 1 which has been cut with the cut edges sufficiently spaced apart from each other to allow the interposition of discharger 6. The screening braid 4 is soldered at 18 to the outer surface of the external electrode 7 which is, moreover, connected to earth at 19. Thus the discharger 6 has a coaxial structure as regards the two electrodes 7 and 10, and has electrical contacts ensuring the electrical continuity so that it can be mounted without difficulty in series on a coaxial line without entailing any notable attenuation of the signal up to a frequency of 2 GHz whilst allowing continuous current to pass.

Figure 2:
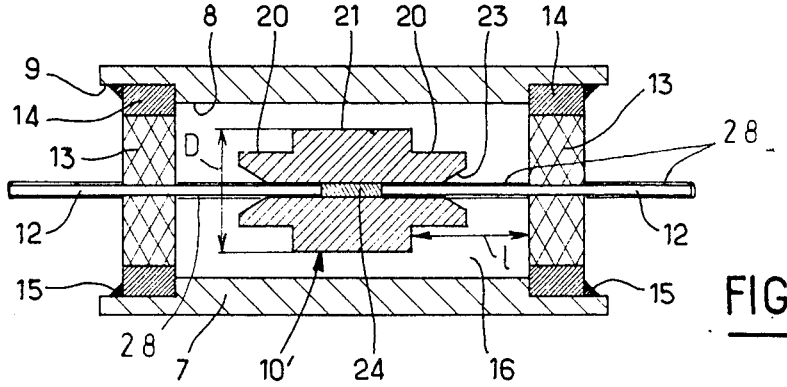
FIG. 2 is an axial cross-sectional view of a preferred variant of the embodiment of the discharger.

In the preferred embodiment represented in FIG. 2, the internal electrode 10' is also a tubular element having two axial end projections 20 with an external diameter which is smaller than that of D of the central cylindrical portion 21. The central or axial passage 22 (see FIG. 3) through the internal electrode 10' opens out at each end of the electrode 10' in a chamfered opening 23 having a frustoconical shape. An electrically conductive element 24, such as a section of silver brazing bead is accommodated in the central passage 22 and the inner ends of the rod elements 12 in the casing 16 are introduced into the central passage 22 by way of the two frustoconical openings 23 and come into contact with the conductive element 24 on its two ends. One of the rod elements 12 is, moreover, kept in position in the central passage 22 by the crimping of the corresponding axial end portion 20 onto this rod element 12 whilst the other rod element 12 is simply engaged in the central passage 22, its position being retained because of the fixing of this rod element 12 to the corresponding glass bead 13 which is itself held in position by the ring 14 brazed on to the external electrode 7.

Figure 3:
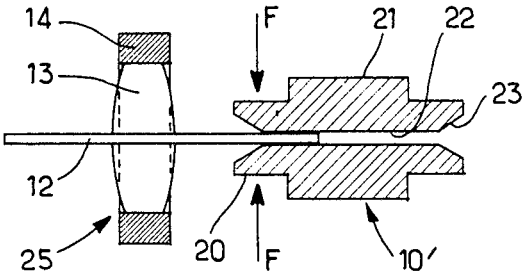
FIG. 3 is an axial cross-sectional view of a subassembly as existing in the course of manufacture and of mounting of the discharger of FIG. 2.
Figure 4:
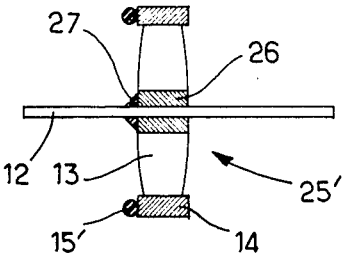
FIG. 4 is an axial cross-sectional view and on a different scale, of a variant of a part of the discharger of FIG. 2.

To produce such a discharger requires manufacture of the two electrodes 7 and 10' and then the building of two fittings such as 25 in FIG. 3 or 25' in FIG. 4 which are made separately and independently. Fitting 25 comprises a rod element 12 carried by a glass bead 13 which it traverses from end to end with a gas-tight seal, whilst an end portion of the rod element 12 projects to either side of bead 13. The rod element 12 extends coaxially through a ring 14 made of "Kovar" into which the bead 13 is fused. Bead 13 may be of a cylindrical or lenticular shape with two domed sides, as shown in FIG. 3 and to a lesser extent in FIG. 4. The inner end portion of the rod element 12 of one of the two fittings 25 is then inserted into the central passage 22 of the internal electrode 10', being guided by the corresponding frustoconical opening 23 and then, as shown by arrows F of FIG. 3, the corresponding axial end portion of this electrode 10' is crimped on this rod element 12, taking care that the length of the rod element 12 engaged in the central passage 22 is less than half of the length of the inner electrode 10'. The crimping of the portion 20 does not, in any way, modify the geometry of the central portion 21 of the internal electrode 10' so that the characteristics of this discharger are not modified by this operation.

There is obtained a sub-assembly which is axially positioned in the tubular external electrode 7 by introducing the internal electrode 10' in its position in bore 8 with the ring 14 in position in the corresponding end recess 9. The second fitting 25 is then positioned by inserting the end of its rod element 12 in the other end of the central passage 22 of the internal electrode 10', being guided by the corresponding frustoconical opening 23, until the ring 14 of this fitting comes to bear on the bottom of the corresponding recess 9 of the external electrode 7. Then two brazing beads, such as 15' on FIG. 4, are disposed on the outside of rings 14 and within the counter bores delimiting recesses 9, and the assembly obtained in this way is placed into a furnace wherein, in the known way, a vacuum is obtained which extracts the gases from casing 16, then the furnace is subjected to a controlled atmosphere (reduced pressure and inert gas). The temperature is then raised up to the brazing temperature which ensures that casing 16 is hermetically sealed.

To ensure the electrical continuity, the conductive element 24 may have been inserted into the central passage 22 of the internal electrode 10' before the engagement of the second rod element 12 into the passage, but it is also possible to omit a conductive element such as 24 and instead, after passing the discharger through the furnace, to subject the two rod elements 12 to a high voltage so as to cause an electric arc to pass between them and internal electrode 10' so that microwelds are produced connecting the rod elements 12 to electrode 10' under the effect of the high current which flows.

As shown in FIG. 4, in order to ensure a gas-tight passage for the rod element 12 through the glass bead 13 of the corresponding fitting 25', it is possible to solder the bead 13 around an inner ring 26, also made of "Kovar", into which the rod element 12 is introduced and then fixed in position by the brazing bead 27 which, moreover, ensures the gas-tight seal between the rod element 12 and the interior of ring 26 which is substantially coaxial with the radially outer ring 14.

To ensure a hermetic seal between the glass beam 13 and rod element 12, this rod element 12 is generally made of ferro-nickel or a similar alloy, whereon glass has good adhesion.

Advantageously, after the bead 13 and rod element 12 have been fitted together, the parts of this rod element 12 which are outside the bead 13 are covered by a copper coating 28.

Coating 28 can have a thickness of approximately $10\mu$. The high frequency conduction is obtained by means of the skin effect in the coating 28 which is a good electrical conductor. This entails less heating than in the case of a rod element 12 which is not provided with such a coating, and a lower attenuation of the signal.

The coating 28 may be deposited electrolytically.

According to the invention, the arc discharge is localised, longitudinally on element 10, or on the central part 21 of element 10'. In view of the mass of element 10, 10', the heating is reduced. The distance of the glass beads 13 from element 10, 10' protects these beads 13 from overheating and from arcs which may flash over at the elements 10, 10'.

I claim:

1. A bipolar overvoltage discharger for a coaxial cable comprising:

a first tubular electrically conductive electrode having an inner surface of circular section defining a central passage having a first end and a second end, a second electrode within said first electrode, said second electrode comprising an electrically conductive element having an outer conductive surface coaxial with the inner conductive surface of the first electrode, and spaced therefrom to define an annular flashover space between said surfaces, first electrically conductive rod means electrically connected to said second electrode and extending axially from a first end thereof, in coaxial relation to said conductive inner surface of the first electrode, second electrically conductive rod means electrically connected to said second electrode and extending axially from a second end thereof, in coaxial relation to said conductive inner surface of the first electrode, said first and second rod means being of a diameter less than the outer conductive surface of the second electrode, and having outer portions extending axially outwardly of the respective ends of said tubular electrode, first and second electrically insulating seal means sealing the respective ends of said first electrode, with respect to said first and second rod means, to define a sealed region between the ends of the first electrode, and a low pressure inert gas in said sealed region, said outer portions of said rod means being adapted to be connected to a central conductor of a coaxial cable, and said first electrode being adapted to be connected to a shielding braid of the coaxial cable.

2. A discharger according to claim 1, wherein said first and second seal means each comprise, a bead of one of glass and ceramic.

3. A discharger according to claim 2, wherein each of said beads is mounted in a gas-tight manner within a metallic ring which is itself mounted in a gas-tight manner at a respective end of the first electrode.

4. A discharger according to claim 2, wherein the second electrode is also a tubular electrode and comprises means defining a central passage coaxial with the outer surface of the second electrode and with the internal surface of the first electrode, the said surfaces constituting the facing surfaces of the two electrodes, and each of the two rod means being held at a first end within the central passages of the second electrode.

5. A discharger according to claim 4, wherein the first end of each of the two rod means is in contact with an electrically conductive element accommodated in the central passage of the internal electrode.

6. A discharger according to claim 4, wherein said first end of each of the two rod means is welded to the internal electrode in the central passage thereof.

7. A discharger according to claim 2, wherein the diameter of said metallic element is substantially twice the diameter of said rod means.

8. A discharger according to claim 2, wherein the portions of rod means outside the said bead are covered with a copper coating.

9. A method of manufacturing a discharger according to claim 2, wherein it consists of:

(i) making separately and individually two fittings each constituted by a bead of one of glass and ceramic mounted and fixed in a gas-tight manner in an outer metallic ring and traversed in a gas-tight manner coaxially with the ring by a metallic rod means which has one end projecting from either side of the said bead;

(ii) fixing one end of said rod means of a first one of the two fittings to an axial end of a said second electrode of the discharger, constituted by a metallic cylindrical element;

(iii) inserting the second electrode coaxially in a said first electrode of the discharger, constituted by a tubular metallic element having a circular cross-section and disposing the bead and the ring of a said fitting fixed to the said second electrode in a position in which the bead obturates one axial end of the central passage of the first electrode;

(iv) positioning the second of said fittings so that its bead and its ring are disposed in a position obturating the other axial end of the central passage of the first electrode and so that the end of its rod means projects inwardly of the first electrode and is in electrical continuity with the second electrode and with the end of the rod means of said first fitting;

(v) disposing brazing beads along the joints connecting the rings of the two fittings and the first electrode;

(vi) disposing the unit in a furnace subjected to a vacuum, then placed under a controlled atmosphere in order to introduce an inert gas at low pressure into the casing delimited by the two fittings within the first electrode; and then (vii) causing the furnace temperature to rise until the brazing joints of the rings on the external electrode are obtained in order to seal said casing in a gas-tight manner.

10. A method according to claim 9, and further comprising (viii) forming an axial passage in the said second electrode so as to give it a tubular shape;

(ix) fixing one end of the rod means of one of the two fittings to an axial end of the second electrode after having inserted said one end of the rod means in the central passage of the said second electrode; and (x) ensuring the electrical continuity of the rod means of the other fitting with the said internal electrode after having also engaged its one end of its said rod means in the central passage of the said second electrode.

11. A method according to claim 9, comprising chamfering an opening at each axial end of the central passage of the second electrode.

12. A method according to claim 9 wherein before said one end of the rod means of the said other fitting is inserted in the central passage of the internal electrode, accommodating an electrically conductive element in said central passage to ensure the electrical continuity between the said one ends of the two rod means which are engaged in the said central passage.

13. A method according to claim 10, wherein after the unit has passed through the furnace, an electric arc is caused to pass along said rod means by subjecting the two rod means to an appropriate voltage so as to weld each of them to said second electrode at its end inserted in the central passage of the second electrode.

14. A method according to claim 9, wherein during the separate and individual manufacture of each of the two fittings in step (i), the corresponding rod means is mounted and fixed in a gas-tight manner within an internal ring which is itself mounted and fixed in a gas-tight manner to the corresponding said bead.

15. A method according to claim 14, wherein said bead is fused to each of said inner and outer rings, and the corresponding rod means is fixed to the internal ring by a brazing bead.

* * * * *